US011120716B2

(12) United States Patent
Hu et al.

(10) Patent No.: US 11,120,716 B2
(45) Date of Patent: Sep. 14, 2021

(54) METHOD FOR DETECTING GAMMA VOLTAGE VALUE, GAMMA CHIP, AND COMPUTER-READABLE STORAGE MEDIUM

(71) Applicant: HKC CORPORATION LIMITED, Guangdong (CN)

(72) Inventors: Shuixiu Hu, Guangdong (CN); Dongsheng Guo, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/039,275

(22) Filed: Sep. 30, 2020

(65) Prior Publication Data

US 2021/0012693 A1 Jan. 14, 2021

Related U.S. Application Data

(63) Continuation of application No. PCT/CN2018/121650, filed on Dec. 18, 2018.

(30) Foreign Application Priority Data

Oct. 23, 2018 (CN) ..... 201811238590.6

(51) Int. Cl.
*G09G 3/00* (2006.01)

(52) U.S. Cl.
CPC ..... *G09G 3/006* (2013.01); *G09G 2320/0276* (2013.01); *G09G 2330/12* (2013.01)

(58) Field of Classification Search
CPC ..... G09G 3/006; G09G 2320/0276; G09G 2330/12
See application file for complete search history.

(56) References Cited

U.S. PATENT DOCUMENTS

| | | | | |
|---|---|---|---|---|
| 7,233,305 | B1 * | 6/2007 | Orlando | G09G 3/3696 345/690 |
| 2002/0158882 | A1 | 10/2002 | Liaw et al. | |
| 2011/0025722 | A1 * | 2/2011 | Chen | G09G 3/3611 345/690 |
| 2016/0284275 | A1 * | 9/2016 | Aflatooni | H03M 1/72 |
| 2017/0278448 | A1 * | 9/2017 | Zhang | G09G 3/2074 |
| 2018/0040295 | A1 * | 2/2018 | Deng | G09G 5/10 |

(Continued)

FOREIGN PATENT DOCUMENTS

| | | | |
|---|---|---|---|
| CN | 102034411 | A | 4/2011 |
| CN | 103325357 | A | 9/2013 |
| CN | 103943088 | A | 7/2014 |

(Continued)

OTHER PUBLICATIONS

First Chinese Office action dated Jan. 2, 2020; Appln. No. 201811238590.6.

(Continued)

*Primary Examiner* — Muhammad N Edun

(57) ABSTRACT

The present application discloses a method for detecting a gamma voltage value, a gamma chip, and a computer-readable storage medium, which includes: when the gamma voltage value generated by the gamma chip being not within a preset voltage range, outputting prompt information corresponding to the gamma voltage value to allow detection by a tester.

14 Claims, 3 Drawing Sheets

(56) References Cited

U.S. PATENT DOCUMENTS

2018/0247577 A1* 8/2018 Han ..... G09G 3/006

FOREIGN PATENT DOCUMENTS

| | | | |
|---|---|---|---|
| CN | 103996391 | A | 8/2014 |
| CN | 105139885 | A | 12/2015 |
| CN | 206322461 | U | 7/2017 |
| CN | 107064773 | A | 8/2017 |

OTHER PUBLICATIONS

Second Chinese Office Action dated Jul. 13, 2020; Appln. No. 201811238590.6.
Chinese Rejection Decision dated Dec. 3, 2020; Appln. No. 201811238590.6.
International Search Report dated Jul. 22, 2019; PCT/CN2018/121650.
Written Opinion dated Jul. 22, 2019; PCT/CN2018/121650.

* cited by examiner

METHOD FOR DETECTING GAMMA VOLTAGE VALUE, GAMMA CHIP, AND COMPUTER-READABLE STORAGE MEDIUM

CROSS-REFERENCE OF RELATED APPLICATIONS

The present application is a continuation application of International Patent Application with No. PCT/CN2018/121650, filed on Dec. 18, 2018, which claims the benefit of a Chinese Patent Application with No. 201811238590.6, titled "METHOD FOR DETECTING GAMMA VOLTAGE VALUE, GAMMA CHIP, AND COMPUTER-READABLE STORAGE MEDIUM", filed in the National Intellectual Property Administration, PRC on Oct. 23, 2018, the entirety of which is hereby incorporated by reference.

TECHNICAL FIELD

The present application relates to the technical field of liquid crystal, and in particular, relates to a method for detecting a gamma voltage value, a gamma chip, and a computer-readable storage medium.

BACKGROUND

At present, Liquid Crystal Display devices have been widely used in the display field. Being the important component of a Thin Film Transistor Liquid Crystal Display, gamma chip plays a vital role in adjusting the gray scale of the display. Specifically, a gamma voltage value is generated by gamma chip and transformed into a gray scale voltage which is then transmitted to a signal driving circuit. The gray scale voltage is then converted into an analog voltage to control deflection of the liquid crystals.

However, the gamma voltage value is often wrongly generated by the gamma chip, due to reasons such as a wrong operation. Since there are generally 14 gamma voltage values, sequentially detecting the gamma voltages would spend a lot of labor force.

The above contents are only provided to assist in understanding the technical solutions of the present application, and do not mean to admit that the above contents are prior Art.

SUMMARY

The main object of the present application is to provide a method for detecting a gamma voltage value, a gamma chip, and a computer-readable storage medium, aiming to enable the gamma chip to autonomously detect whether the gamma voltage value is correct, thereby improving the detection efficiency and saving labor force.

In order to achieve the above object, the present application provides a method for detecting a gamma voltage value, which includes the following operations:

acquiring the gamma voltage value generated by a gamma chip; acquiring a preset voltage range of the gamma chip; and outputting prompt information corresponding to the gamma voltage value to allow detection by a tester, when the gamma voltage value being not within the preset voltage range.

Optionally, before the operation of acquiring a gamma voltage value generated by a gamma chip, the method also includes: extracting a gamma curve in a first storage space of the gamma chip; and generating the gamma voltage value according to the gamma curve.

Optionally, the operation of acquiring a preset voltage range of the gamma chip includes: acquiring the preset gamma voltage value; and acquiring the preset voltage range according to the preset gamma voltage value.

Optionally, the operation of acquiring a preset gamma voltage value of the gamma chip includes: acquiring the preset gamma voltage value from a second storage space of the gamma chip.

Optionally, the operation of acquiring a preset voltage range according to the preset gamma voltage value includes: acquiring the preset deviation value from a second storage space of the gamma chip; and acquiring the preset voltage range according to the preset gamma voltage value and the preset deviation value.

Optionally, the operation of acquiring a preset voltage range according to the preset gamma voltage value and the preset deviation value includes: acquiring a sum of the preset gamma voltage value and the preset deviation value; acquiring a difference between the preset gamma voltage value and the preset deviation value; and determining the preset voltage range according to the sum of the preset gamma voltage value and the preset deviation value, and the difference between the preset gamma voltage value and the preset deviation value.

Optionally, the method for detecting a gamma voltage also includes: acquiring a target deviation value corresponding to an instruction, when receiving the instruction for changing the preset deviation value; and updating the preset deviation value in the second storage space according to the target deviation value.

Optionally, after the operation of outputting prompt information corresponding to the gamma voltage value, the method also includes: stopping the gamma chip from generating the gamma voltage value.

Optionally, the operation of stopping the gamma chip from generating the gamma voltage value includes: cutting off a power for the gamma chip.

Optionally, the operation of acquiring the preset voltage range of the gamma chip includes: acquiring the preset voltage range from a second storage space of the gamma chip.

Optionally, the method for detecting a gamma voltage also includes: acquiring a target voltage range corresponding to an instruction, when receiving the instruction for changing the preset voltage range; and updating the preset voltage range in the second storage space according to the target voltage range.

Optionally, the gamma chip is correspondingly defined with at least one preset voltage range.

Optionally, the preset voltage range includes a first preset voltage range and a second preset voltage range, the prompt information is output when the gamma voltage value is not in the first preset voltage range, and the gamma chip is stopped from the generation when the preset voltage range is not in the second preset voltage range.

Optionally, the operation of outputting prompt information corresponding to the gamma voltage value also includes: outputting prompt information corresponding to the gamma voltage value to a preset terminal.

Optionally, the prompt information is sent in a form of a display interface or a voice output.

Optionally, after the operation of outputting prompt information corresponding to the gamma voltage value, the method also includes: stopping the gamma chip from generating the gamma voltage value within a preset time interval, after the prompt information is output.

In order to achieve the above object, the present application also provides a gamma chip, which includes a memory, a processor, and a program for detecting a gamma voltage value, the program being stored in the memory and executable by the processor. And the gamma chip also includes a first storage space and a second storage space, the first storage space is configured to store a gamma curve, the second storage space is configured to store a preset gamma voltage value, a preset deviation value, and a preset voltage range, and the processor executes the program to implement a method for detecting a gamma voltage which includes: extracting the gamma curve of the gamma chip in the first storage space, and generating the gamma voltage value according to the gamma curve; acquiring the preset gamma voltage value of the gamma chip, and acquiring the preset voltage range according to the preset gamma voltage value; and outputting prompt information corresponding to the gamma voltage value to allow detection by a tester, when the gamma voltage value is not within the preset voltage range.

In order to achieve the above object, the present application also provides a computer-readable storage medium, a program for detecting a gamma voltage is stored in the computer-readable storage medium, the processor executes the program to implement a method for detecting a gamma voltage which includes: extracting a gamma curve in a first storage space of a gamma chip, and generating a gamma voltage value according to the gamma curve; acquiring a preset gamma voltage value of the gamma chip, and acquiring a preset voltage range according to the preset gamma voltage value; and outputting prompt information corresponding to the gamma voltage value to allow detection by a tester, when the gamma voltage value is not within the preset voltage range.

According to the method for detecting a gamma voltage value, the gamma chip and the computer readable storage medium provided by the present application, a gamma voltage value generated by the gamma chip and a preset voltage range of the gamma chip are acquired, and when the gamma voltage value is not in the preset voltage range, prompt information corresponding to the gamma voltage value is output to allow detection by testers. The gamma chip may autonomously detect whether the gamma voltage value is correct in the present application, thereby improving the detection efficiency and saving labor force.

The realization, functional features and advantages of the purpose of the present disclosure will be also described with reference to the accompanying drawings in conjunction with the embodiments.

DETAILED DESCRIPTION OF THE EMBODIMENT

It should be understood that the specific embodiments described herein are only for the purpose of explaining the present disclosure and are not intended to limit the present disclosure.

The present application provides a method for detecting a gamma voltage value, to realize that the gamma chip may autonomously detect whether the gamma voltage value is correct, thereby improving the detection efficiency and saving labor force.

Figure 1:
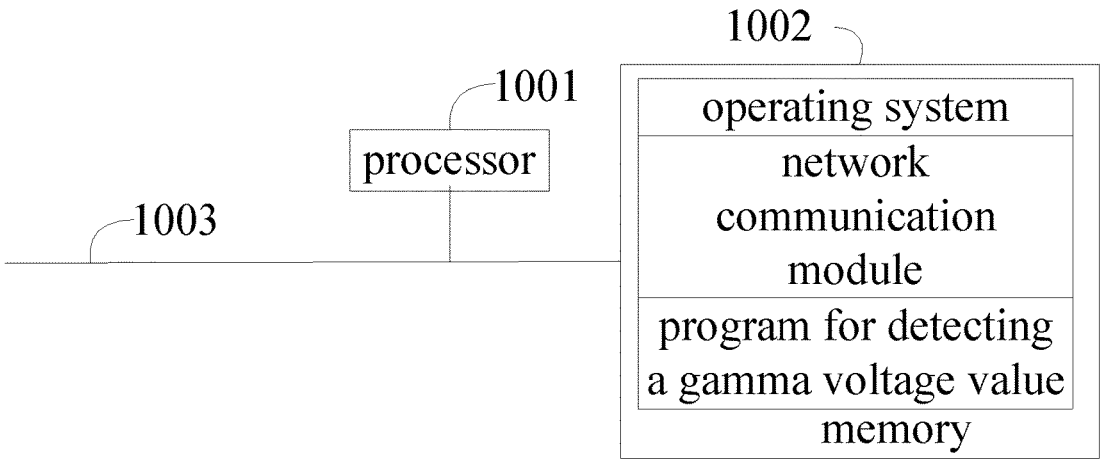
FIG. 1 is a schematic diagram of a terminal hardware operating environment according to some embodiments of the present application.

As shown in FIG. 1, FIG. 1 is a schematic diagram of a terminal hardware operating environment according to some embodiments of the present application.

The terminal in the embodiments of the present application is a gamma chip. Referring to FIG. 1, the terminal may include a processor 1001, such as a Central Processing Unit (CPU), a memory 1002, and a communication bus 1003. And, the communication bus 1003 is configured to enable connecting communication between the components of the terminal. The memory 1002 may be a high-speed Random-Access Memory (RAM) or a Non-Volatile Memory, such as a disk memory. The memory 1002 may optionally be a memory device independent from the aforementioned processor 1001.

It may be understood by those skilled in the art that the terminal structure shown in FIG. 1 does not constitute a limitation of the terminal, and may include more or fewer components than that are shown in the FIG. 1, or may combine some components, or may be different arrangements of the components.

As shown in FIG. 1, a memory 1002 as a computer storage medium may include a program for detecting a voltage value, and a processor 1001 may be configured to enable the program stored in the memory 1002 and perform the following operations: acquiring a Gamma voltage value generated by a Gamma chip; acquiring a preset voltage range of the Gamma chip; and outputting prompt information corresponding to the gamma voltage value to allow detection by a tester, when the gamma voltage value is not within the preset voltage range.

Further, the processor 1001 may be configured to enable a program for detecting a gamma voltage value stored in the memory 1002 and execute the following operations:

extracting a gamma curve of the gamma chip in a first storage space; and generating the gamma voltage value according to the gamma curve.

Further, the processor 1001 may be configured to enable a program for detecting a gamma voltage value stored in the memory 1002 and execute the following operations:

acquiring a preset gamma voltage value; and acquiring the preset voltage range according to the preset gamma voltage value.

Further, the processor 1001 may be configured to enable a program for detecting a gamma voltage value stored in the memory 1002 and execute the following operations:

acquiring the preset gamma voltage value from a second storage space of the gamma chip.

Further, the processor 1001 may be configured to enable a program for detecting a gamma voltage value stored in the memory 1002 and perform the following operations: acquiring a preset deviation value from a second storage space of the gamma chip; and acquiring the preset voltage range according to the preset gamma voltage value and the preset deviation value.

Further, the processor 1001 may be configured to enable a program for detecting a gamma voltage value stored in the memory 1002 and perform the following operations: acquiring a sum of the preset gamma voltage value and the preset deviation value; acquiring a difference between the preset gamma voltage value and the preset deviation value; and determining the preset voltage range according to the sum of the preset gamma voltage value and the preset deviation value, and the difference between the preset gamma voltage value and the preset deviation value.

Further, the processor 1001 may be configured to enable a program for detecting a gamma voltage value stored in the memory 1002 and perform the following operations: acquiring a target deviation value corresponding to an instruction, when receiving the instruction for changing the preset deviation value; updating the preset deviation value in the second storage space according to the target deviation value.

Further, the processor 1001 may be configured to enable a program for detecting a gamma voltage value stored in the memory 1002 and perform the following operations: stopping the gamma chip from generating the gamma voltage value.

Further, the processor 1001 may be configured to enable a program for detecting a gamma voltage value stored in the memory 1002 and perform the following operations: cutting off a power for the gamma chip.

Further, the processor 1001 may be configured to enable a program for detecting a gamma voltage value stored in the memory 1002 and perform the following operations: acquiring the preset voltage range from a second storage space of the gamma chip.

Further, the processor 1001 may be configured to enable a program for detecting a gamma voltage value stored in the memory 1002 and perform the following operations: acquiring a target voltage range corresponding to an instruction, when receiving the instruction for changing the preset voltage range; and updating the preset voltage range in the second storage space according to the target voltage range.

Further, the processor 1001 may be configured to enable a program for detecting a gamma voltage value stored in the memory 1002 and perform the following operations: the gamma chip is correspondingly defined with at least one preset voltage range.

Further, the processor 1001 may be configured to enable a program for detecting a gamma voltage value, which is stored in the memory 1002, and to perform the following operation: with the preset voltage range including a first preset voltage range and a second preset voltage range, outputting the prompt information when the gamma voltage value is not in the first preset voltage range, and the stopping the gamma chip from generating the gamma voltage value when the preset voltage range is not in the second preset voltage range.

Further, the processor 1001 may be configured to enable a program for detecting a gamma voltage value stored in the memory 1002 and perform the following operations: outputting prompt information corresponding to the gamma voltage value to a preset terminal.

Further, the processor 1001 may be configured to enable a program for detecting a gamma voltage value stored in the memory 1002 and perform the following operations: sending out the prompt information in the form of a display interface or voice output.

Further, the processor 1001 may be configured to enable a program for detecting a gamma voltage value stored in the memory 1002 and perform the following operations: stopping the gamma chip from generating the gamma voltage value within a preset time interval, after the prompt information is output.

Figure 2:
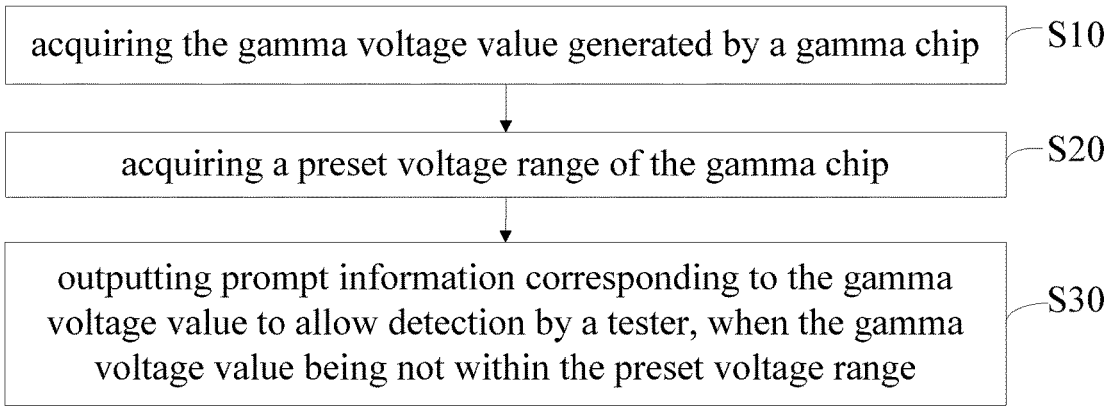
FIG. 2 is a flow chart of a method for detecting a gamma voltage value according to some embodiments of the present application.

Referring to FIG. 2, in some embodiments, the method for testing a gamma voltage includes:

S10, acquiring the gamma voltage value generated by a gamma chip;

In the embodiments, the gamma circuit is generally composed of two parts. Regarding the first part, a total of 14 gamma voltage values V1-V14 are generated in the gamma resistor network string R0-R14 on the central control board, taking the analog voltage as the reference voltage. The second part generates voltages of all gray scales, by inputting these 14 gamma voltage values into a source current and combining the gamma resistor network string with the source current. For example, for 8 bit data, the gamma circuit on the central control board only generates 14 gamma voltage values which, when input to the source current, combines the gamma circuit in the source current to further generate a total of 256 reference voltages VL0-VL255. These 256 reference voltages respectively correspond to the voltage values of 256 gray scales. Generally, the gamma resistor network inside the source current would not be adjusted once determined during chip manufacturing process.

The debugging of the gamma circuit is to substantially acquire a required gamma voltage value by adjusting the gamma resistor network in the central control board, so that the gamma curve meets the requirements. In order to quickly complete the gamma debugging, the integrated circuit of the gamma curve may be digitally debugged by software. The integrated circuit integrates the encodable gamma resistor network string and VCOM voltage, and may perform gamma adjustment through I2C bus.

S20, acquiring a preset voltage range of the gamma chip.

In some embodiments, the gamma chip includes at least a first storage space and a second storage space. The first storage space may be configured to store a gamma curve, and the second storage space may be configured to store a preset gamma voltage value, a preset deviation value, and a preset voltage range. The preset gamma voltage value is the gamma voltage value generated by the gamma chip tested before leaving the factory, and is stored in the second storage space of the gamma chip as a standard value. And it is judged whether the gamma voltage value is qualified according to the preset gamma voltage value when the gamma voltage value is generated by the gamma chip. The preset deviation value is a value set to allow the gamma voltage value to fluctuate within a certain error range, which is stored in a second storage interval and may be set and changed by a user.

In the embodiments, the preset voltage range may be a preset voltage range determined based on a preset gamma voltage value and a preset deviation value. For example, the preset gamma voltage value plus the preset deviation value to obtain an upper limit of the range, and the preset gamma voltage value minus the preset deviation value to obtain a lower limit of the range, forming the preset voltage range. The preset voltage range stored in the second storage space may also be a range preset based on a preset gamma voltage value before leaving the factory. A plurality of preset voltage ranges may be defined. For example, it may include a first preset voltage range and a second preset voltage range. The prompt information is output when the gamma voltage value is not in the first preset voltage range, and the gamma chip is stopped from being generated when the preset voltage range is not in the second preset voltage range.

It should be noted that it is likely to set no preset deviation value. If the gamma voltage value is inconsistent with the preset gamma voltage value, the gamma voltage value is determined unqualified.

S30, outputting prompt information corresponding to the gamma voltage value to allow detection by a tester, when the gamma voltage value being not within the preset voltage range.

In the embodiments, when a gamma voltage value is acquired, a preset voltage range corresponding to the gamma voltage value is then acquired. And whether the gamma voltage value is within the preset voltage range is further determined. When the gamma voltage value being not within the preset voltage range, it indicates that the gamma voltage value has exceeded the error range, and a prompt message is output to indicate testers to detect and confirm the gamma voltage value. The testers may detect the main gamma voltage value corresponding to the prompt information, thus saving the workload.

In which, the prompt message may be: "V1 gamma voltage value is abnormal, please confirm!". The form of the prompt information output may be voice broadcast or text. The prompt information may also be sent to the preset terminals, including computers, mobile phones and other devices.

In the embodiments, after the prompt information is output, the process of generating the gamma voltage value by the gamma chip is stopped. The specific means of stopping may be to cutting off the power for the gamma chip, etc. It should be noted that the operation of stopping the gamma chip from generating the gamma voltage value may be set according to the actual application, such as before, after, or with the operation of outputting the prompt information, which is not specifically limited in the present application. For example, the operation of stopping the gamma chip from generating the gamma voltage value may be set to stop the gamma chip from being generated in a preset time after receiving the stopping instruction, when being subsequent to the operation of outputting the prompt information.

In the embodiments, a gamma voltage value generated by the gamma chip and a preset voltage range of the gamma chip are acquired, and when the gamma voltage value is not in the preset voltage range, prompt information corresponding to the gamma voltage value is output to allow detection by testers. The gamma chip may autonomously detect whether the gamma voltage value is correct, thereby improving the detection efficiency and saving labor force.

Figure 3:
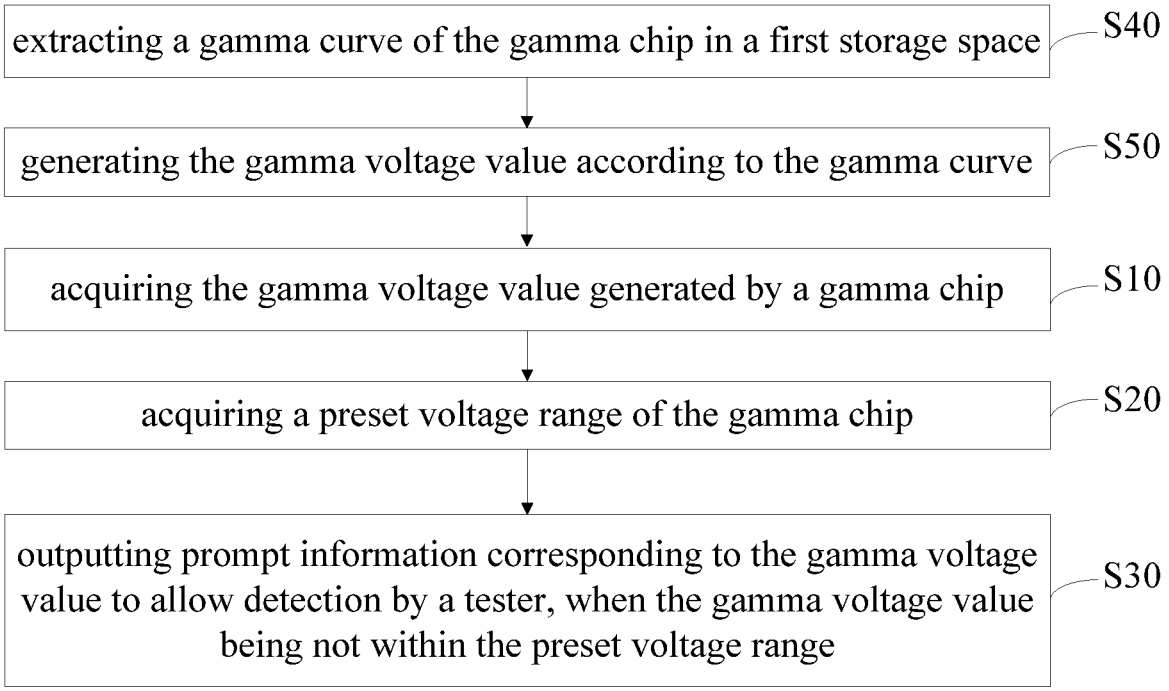
FIG. 3 is a flow chart of a method for detecting a gamma voltage value according to some embodiments of the present application.

In some embodiments, as shown in FIG. 3, on the basis of the embodiments shown in FIG. 2, before the operation of acquiring a preset gamma voltage value generated by the gamma chip, the method also includes:

S40, extracting a gamma curve of the gamma chip in a first storage space; and, S50, generating the gamma voltage value according to the gamma curve.

In the embodiments, the gamma chip includes at least a first storage space and a second storage space, the first storage space may be configured to store a gamma curve.

The gamma chip may generate the gamma voltage value according to the gamma curve. The debugging of the gamma circuit is substantially acquiring a required gamma voltage value by adjusting the gamma resistor network in the central control board, so that the gamma curve meets the requirements. In order to quickly complete the gamma debugging, the integrated circuit of the gamma curve may be digitally debugged by software. The integrated circuit integrates the encodable gamma resistor network string and VCOM voltage, and may adjust gamma through I2C bus.

In the embodiments, the gamma voltage value is generated according to the gamma curve, ensuring accuracy of the gamma voltage value.

Figure 4:
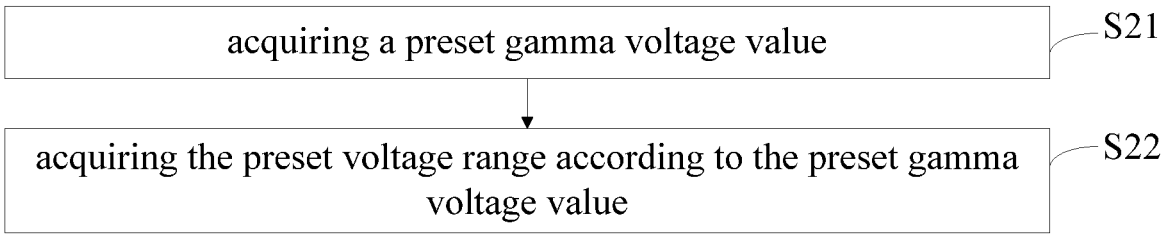
FIG. 4 is a flow chart of a method for detecting a gamma voltage value according to some embodiments of the present application.

In some embodiments, as shown in FIG. 4, on the basis of the embodiments shown in any one of FIGS. 2 to 3, the operation of acquiring a preset voltage range of the gamma chip includes:

S21, acquiring a preset gamma voltage value; and

S22, acquiring the preset voltage range according to the preset gamma voltage value.

In the embodiments, the preset gamma voltage value is the gamma voltage value generated by the gamma chip tested before leaving the factory, and is stored in the second storage space of the gamma chip as a standard value. It is detected that whether the Gamma voltage value is qualified or not, by comparing the relationship between the gamma voltage and the preset gamma voltage value, when the gamma voltage value is generated by the gamma chip.

The preset voltage range may be set based on the preset gamma voltage value. Specifically, the preset voltage range may be directly set before leaving from factory, and may be stored in the second storage space. Also, the preset voltage range may be derived through the preset gamma voltage value plus the preset deviation value to gain an upper limit of the range, and the preset gamma voltage value minus the preset deviation value to obtain a lower limit of the range. The preset deviation value is stored in a second storage interval and may be manually set and changed by a user.

In some embodiments, the preset voltage range is acquired according to the preset gamma voltage value, thus realizing self-detection of the gamma chip.

Figure 5:
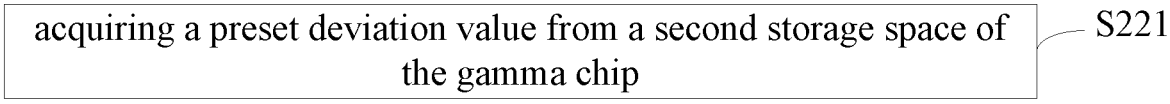
FIG. 5 is a flow chart of a method for detecting a gamma voltage value according to some embodiments of the present application.

In some embodiments, as shown in FIG. 5, on the basis of the embodiments shown in FIGS. 2 to 4, the operation of acquiring a preset gamma voltage value of the gamma chip includes: S211 acquiring the preset gamma voltage value from a second storage space of the gamma chip.

In some embodiments, the gamma chip includes at least a first storage space and a second storage space, the second storage space may be configured to store a preset gamma voltage value, a preset deviation value, and a preset voltage range.

The preset gamma voltage value is the gamma voltage value generated by the gamma chip tested before leaving the factory, and is stored in the gamma chip as a standard value, so as to judge whether the gamma voltage value is qualified according to the preset gamma voltage value when the gamma voltage value being generated by the gamma chip.

In some embodiments, the preset gamma voltage value is stored in the second storage space of the gamma chip, thus realizing self-detection of the gamma chip.

Figure 6:
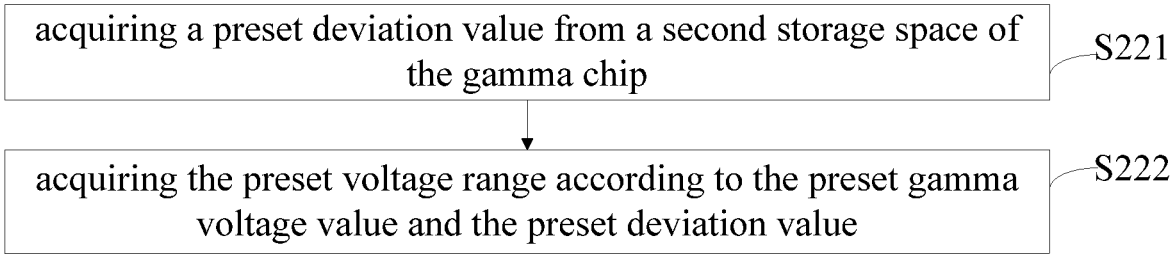
FIG. 6 is a flow chart of a method for detecting a gamma voltage value according to some embodiments of the present application.

In some embodiments, as shown in FIG. 6, on the basis of the embodiments shown in FIGS. 2 to 5, the operation of acquiring a preset voltage range according to the preset gamma voltage value includes:

S221, acquiring a preset deviation value from a second storage space of the gamma chip; and, S222, acquiring the preset voltage range according to the preset gamma voltage value and the preset deviation value.

In some embodiments, the gamma chip includes at least a first storage space and a second storage space, the first storage space may be configured to store a gamma curve, and the second storage space may be configured to store a preset gamma voltage value, a preset deviation value, and a preset voltage range. The gamma curve and each preset gamma voltage value stored in the gamma chip have been set before leaving from factory. The preset deviation value is set to allow the gamma voltage value to fluctuate within a certain error range. The preset deviation value is stored in a second storage interval and may be manually set and changed by a user.

The preset voltage range may be determined according to the preset gamma voltage value and the preset deviation value. Specifically, the preset gamma voltage value may plus the preset deviation value to gain an upper limit of the range, and the preset gamma voltage value minus the preset deviation value to obtain a lower limit of the range, forming the preset voltage range.

In some embodiments, the preset voltage range is acquired according to the preset gamma voltage value and the preset deviation value. And whether the gamma voltage value is qualified is judged according to the preset voltage range, realizing self-detection of the gamma chip.

Figure 7:
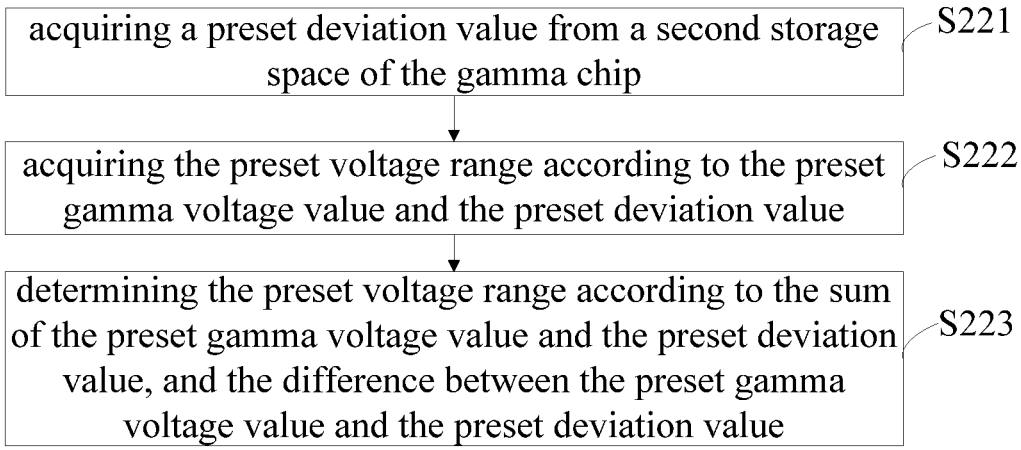
FIG. 7 is a flow chart of a method for detecting a gamma voltage value according to some embodiments of the present application.

In some embodiments, as shown in FIG. 7, on the basis of the embodiments shown in FIGS. 2 to 6, the operation of acquiring a preset voltage range according to the preset gamma voltage value and the preset deviation value includes:

S2221, acquiring a sum of the preset gamma voltage value and the preset deviation value;

S2222 acquiring a difference between the preset gamma voltage value and the preset deviation value; and S2223 determining the preset voltage range according to the sum of the preset gamma voltage value and the preset deviation value, and the difference between the preset gamma voltage value and the preset deviation value.

In the embodiments, the preset gamma voltage value plus the preset deviation value to obtain an upper limit of the range, and the preset gamma voltage value minus the preset deviation value to obtain a lower limit of the range, forming the preset voltage range. And whether the gamma voltage value is qualified is judged according to the preset voltage range, realizing self-detection of the gamma chip.

Figure 8:
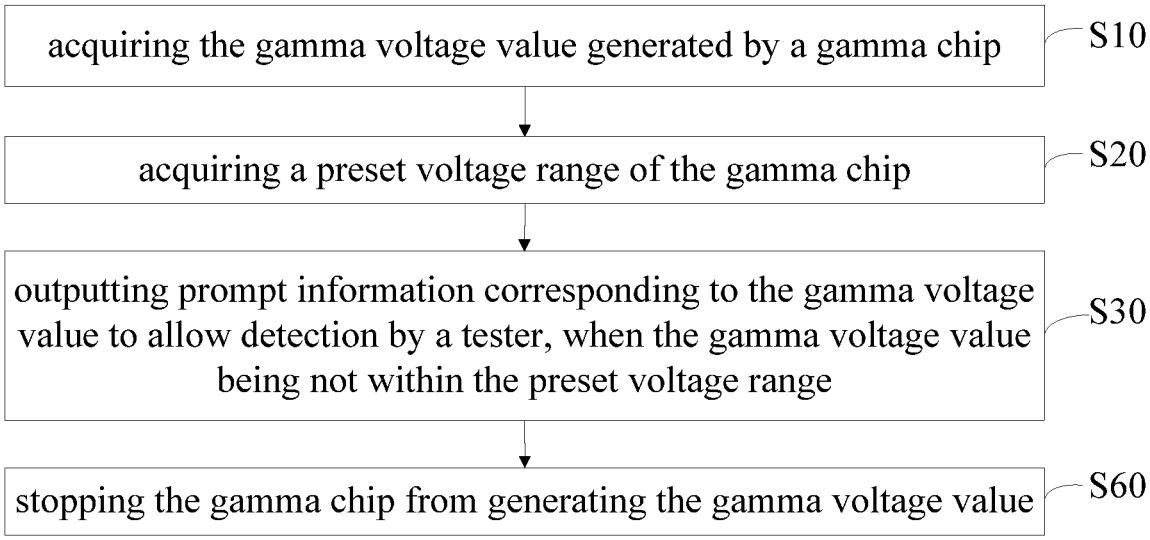
FIG. 8 is a flow chart of a method for detecting a gamma voltage value according to some embodiments of the present application.

In some embodiments, as shown in FIG. 8, on the basis of the embodiments shown in FIGS. 2 to 7, after the operation of outputting prompt information corresponding to the gamma voltage value, the method also includes:

S60 stopping the gamma chip from generating the gamma voltage value.

In the embodiments, when the gamma voltage value being not within the preset voltage range, it indicates that the gamma voltage value has exceeded the error range, and a prompt message is output to prompt the tester to detect and confirm the gamma voltage value. The tester may detect the main gamma voltage value corresponding to the prompt information, thus saving the workload.

After outputting the prompt information, the process of generating the gamma voltage value by the gamma chip is stopped. The specific means of the stopping may be to cutting off the power for the gamma chip, etc. It should be noted that the operation of stopping the gamma chip from generating the gamma voltage value may be set according to the actual application, such as before, after, or with the operation of outputting the prompt information, which is not specifically limited in the present application. For example, the operation of stopping the gamma chip from generating the gamma voltage value may be set within a preset time after the stopping instruction is received and the prompt information is output.

In some embodiments, when the gamma voltage value is detected to be unqualified, the gamma chip is stopped from generating the gamma voltage value, thus ensuring the accuracy of generating the gamma voltage value by the gamma chip.

Figure 9:
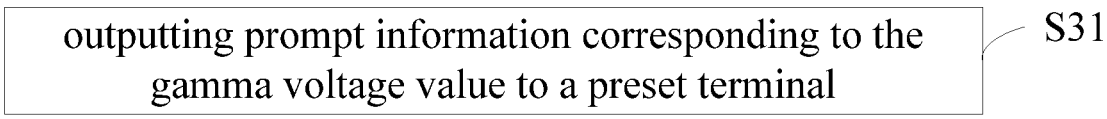
FIG. 9 is a flow chart of a method for detecting a gamma voltage value according to some embodiments of the present application.

In some embodiments, as shown in FIG. 9, on the basis of the embodiments shown in FIGS. 2 to 8, the operation of outputting prompt information corresponding to the gamma voltage value includes:

S31 outputting prompt information corresponding to the gamma voltage value to a preset terminal.

In the embodiments, the prompt message may be: "V1 gamma voltage value is abnormal, please confirm!". The prompt information is sent in a form of a display interface or a voice output.

The prompt information may be output to preset terminals, such as computers, mobile phones and other devices.

In the embodiments, the prompt information corresponding to the gamma voltage value is output to the preset terminal, so that to timely remind the testers to carry out the detection.

The present application also provides a gamma chip, which includes a memory, a processor, and a program for detecting a gamma voltage. The program is stored in the memory and executable by the processor. And the gamma chip further includes a first storage space and a second storage space, the first storage space is configured to store a gamma curve, the second storage space is configured to store a preset gamma voltage value, a preset deviation value, and a preset voltage range, and the program configured to implement the method for detecting a gamma voltage based on the gamma chip.

The embodiment of the present application also provides a computer-readable storage medium, a program for detecting a gamma voltage is stored in the computer-readable storage medium, the processor executes the program to implement the method for detecting a gamma voltage based on the gamma chip.

The above-mentioned serial numbers of the embodiments of the present disclosure are for the purpose of description only and do not represent the advantages and disadvantages of the embodiments.

From the description of the above embodiments, it is clear to those skilled in the art that the method of the above embodiments may be implemented by means of software combined with necessary general hardware platform, although it may also be implemented by hardware, but in many cases the former is an alternative embodiment. Based on such understanding, the technical schemes of the present disclosure, in essence, or the part contributing to the prior art, may be embodied in the form of a software product. The software product is stored in a storage medium (such as ROM/RAM, magnetic disk, optical disk) as described above, including several instructions for enabling a terminal device (which may be a television, a mobile phone, computer, server, air conditioner, or network device, etc.) to perform the methods described in various embodiments of the present disclosure.

The above are only alternative embodiments of the present application, and not a limitation on the patent scope of the present application. Any equivalent structure or equivalent flow transformation made by using the description and drawings of the present application, or directly or indirectly applied in other related technical fields, are similarly included in the patent protection scope of the present application.

What is claimed is:

1. A method for detecting a gamma voltage value, comprising:

acquiring the gamma voltage value generated by a gamma chip;

acquiring a preset gamma voltage value of the gamma chip;

acquiring a preset deviation value from a second storage space of the gamma chip;

acquiring a sum of the preset gamma voltage value and the preset deviation value;

acquiring a difference between the preset gamma voltage value and the preset deviation value; and determining the preset voltage range according to the sum of the preset gamma voltage value and the preset deviation value, and the difference between the preset gamma voltage value and the preset deviation value; and outputting prompt information corresponding to the gamma voltage value to allow detection by a tester, when the gamma voltage value is not within the preset voltage range.

2. The method according to claim 1, wherein the method further comprises:

acquiring a target deviation value corresponding to an instruction, when the instruction for changing the preset deviation value is received; and updating the preset deviation value in the second storage space according to the target deviation value.

3. The method according to claim 1, wherein after the operation of outputting prompt information corresponding to the gamma voltage value, the method further comprises:

stopping the gamma chip from generating the gamma voltage value.

4. The method according to claim 3, wherein the operation of stopping the gamma chip from generating the gamma voltage value comprises:

cutting off a power for the gamma chip.

5. The method according to claim 4, wherein the method further comprises:

acquiring a target voltage range corresponding to an instruction, when the instruction for changing the preset voltage range is received; and updating the preset voltage range in the second storage space according to the target voltage range.

6. The method according to claim 1, wherein the gamma chip defines correspondingly at least one preset voltage range.

7. The method according to claim 6, wherein the preset voltage range comprises a first preset voltage range and a second preset voltage range, wherein the prompt information is output when the gamma voltage value is not in the first preset voltage range, and the gamma chip is stopped from generating the gamma voltage value when the preset voltage range is not in the second preset voltage range.

8. The method according to claim 1, wherein the operation of outputting the prompt information corresponding to the gamma voltage value, comprises:

outputting the prompt information corresponding to the gamma voltage value to a preset terminal.

9. The method according to claim 1, wherein the prompt information is sent in a form of a display interface or a voice output.

10. The method according to claim 1, wherein after the operation of outputting prompt information corresponding to the gamma voltage value, the method further comprises:

stopping the gamma chip from generating the gamma voltage value in a preset time, after the prompt information is output.

11. A gamma chip, comprising a memory, a processor, and a program for detecting a gamma voltage value, the program being stored in the memory and executable by the processor, wherein, when the program is executed by the processor, the method for detecting a gamma voltage value according to claim 1 is realized.

12. A non-transitory computer-readable storage medium, wherein a program for detecting a gamma voltage is stored in the non-transitory computer-readable storage medium, and the program is executable by a processor to implement the method for detecting a gamma voltage value according to claim 1.

13. The method according to claim 1, wherein before the operation of acquiring the gamma voltage value generated by the gamma chip, the method further comprises:

extracting a gamma curve in a first storage space of the gamma chip; and, generating the gamma voltage value according to the gamma curve.

14. The method according to claim 1, wherein the operation of acquiring the preset gamma voltage value, comprises:

acquiring the preset gamma voltage value from a second storage space of the gamma chip.

* * * * *